United States Patent [19]

Sapitowicz et al.

[11] 4,349,283

[45] Sep. 14, 1982

[54] HAMMER FOR DOT MATRIX PRINTER

[75] Inventors: Thomas P. Sapitowicz, Bel Air; Robert A. Meloni, Baltimore, both of Md.

[73] Assignee: General Instrument Corporation

[21] Appl. No.: 184,311

[22] Filed: Sep. 5, 1980

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,101,291 | 8/1963 | Lalick | 248/538 X |
| 3,225,269 | 12/1965 | Worcester | 335/300 X |
| 3,971,311 | 7/1976 | Deproux | 101/93.04 |
| 4,022,311 | 5/1977 | Krull | 400/124 |
| 4,033,255 | 7/1977 | Kleist et al. | 101/93.04 |
| 4,044,668 | 8/1977 | Barrus et al. | 400/124 |
| 4,129,390 | 12/1978 | Bigelow et al. | 400/121 |

FOREIGN PATENT DOCUMENTS

| | | | |
|---|---|---|---|
| 2035220 | 6/1980 | United Kingdom | 400/124 |

*Primary Examiner*—Paul T. Sewell

*Attorney, Agent, or Firm*—James and Franklin

[57] ABSTRACT

Each hammer includes a frame-like portion with a recess into which an electrically energizable flat coil is received. Affixed to opposite sides of the frame portion, and extending therefrom over the recess in contact with the sides of the coil, are thermally conductive metallic foil sheets which serve to dissipate heat from the coil, retain the coil intact and maintain the proper position of the coil relative to the frame. The exterior surfaces of the sheets form bearing surfaces to protect the hammer and coil from wear caused by contact with other parts of the head as the hammer is displaced. An elongated recess is formed along the axis of a portion of the frame, in the direction of displacement, by cutting transverse slots therein so as to form a plurality of clamping elements, alternate ones of which are situated on opposite sides of the axis. A print wire is received within the recess and frictionally engaged by the elements so as to form a strong rigid joint without significantly increasing the mass or thickness of the hammer. The print wire is affixed to the frame portion at the center of percussion thereof to eliminate torsional vibrations, otherwise created on impact.

14 Claims, 5 Drawing Figures

FIG. 4
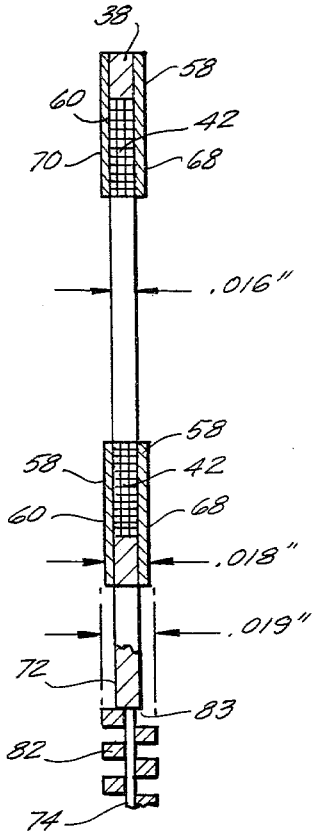
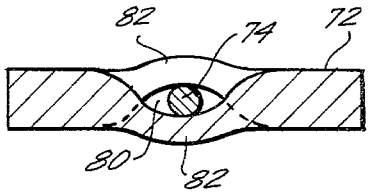
FIG. 5

HAMMER FOR DOT MATRIX PRINTER

BACKGROUND OF THE INVENTION

The present invention relates to a hammer designed for use in a print head of a dot matrix printer or the like and, more particularly, to a hammer structure which includes a heat dissipating means, displaceable with the hammer, which retain and protect the coil, and to the location of and structure for mounting a print wire thereto.

A dot matrix printer is an apparatus which prints a plurality of closely spaced dots at high speed at selected locations on a paper strip to form letters, numerals or other intelligible symbols thereon. The dots are formed by causing contact between the paper and an ink impregnated surface at the desired locations by selectively electromagnetically displacing elongated print wires mounted within the print head.

One type of conventional dot matrix print head consists of a plurality of selectively electrically energizable solenoids, each of which has a separate print wire extending therefrom. The impact ends of the print wires are retained in position with respect to the paper, and each other, by a wire bearing having a plurality of closely spaced openings therein arranged in a matrix array. Energization of a selected solenoid results in the print wire associated therewith being displaced, such that the impact end thereof causes contact between the paper and the ink impregnated surface to print a dot in the desired location.

However, such heads are bulky and massive, as well as complex in structure, and therefore, relatively expensive to manufacture and maintain. Since the solenoids each require a space much greater than the distance between the impact ends of the print wires connected thereto, complicated arrangements of the solenoids are required for a sufficient number of solenoids to be incorporated into the head to provide the required number of print wires. For this reason, the solenoids had to be arranged in groups or banks at different levels or in arcuate arrays. When arranged at different levels, each group of solenoids was provided with print wires of different length, depending upon how far the group was spaced from the wire bearing. When arranged in an arcuate array, the print wires were curved to various degrees, according to the placement of each solenoid.

Solenoids generate a significant amount of heat upon repeated actuation. Because the solenoid actuators are packed closely together, the heat generated by the solenoids builds up rapidly. Thus, provision had to be made to dissipate the heat generated by the solenoids to prevent the heat build-up from destroying the head. In order to accomplish this result, massive metallic heat dissipating elements or sinks were affixed to the head frame adjacent the exteriors of the solenoids. While the presence of the massive heat sinks substantially increased the bulk and weight of the head, the mass thereof did not interfere with the displacement of the print wires because the solenoids, and thus, the heat sinks mounted adjacent the exteriors thereof, remain stationary as the print wires are displaced.

In order to reduce the weight, bulk and cost of the print head, solenoid actuators have recently been replaced with extremely thin, coil carrying hammer type actuators. Hammers of this type are so thin that a plurality of closely spaced, parallelly situated hammers can be mounted between a single pair of stationary magnets.

Each hammer comprises a thin, flexible planar frame portion having a recess therein into which a flat coil is received. The coil carrying portion is suspended from a support, in cantilever fashion, by an elongated flexible portion, such that it is situated in a non-varying magnetic field created between the magnets. The leads of the coil are connected to circuitry designed to electrically energize the coil when actuated. A print wire is mounted to and extends from the bottom of the frame portion and is displaceable therewith. When the coil is electrically energized, sufficient electromagnetic force is developed to displace the hammer from its original position such that the impact end of the print wire is moved to cause a dot to be imprinted on the paper.

Since each hammer must be extremely thin to permit a plurality thereof to be mounted in the small space between the magnets, the thickness of the coil and, thus, the number of wire turns in the coil, is limited. The strength of the permanent magnets is also limited, and thus, the amount of electromagnetic force developed by energization of the coil is relatively small. Moreover, the printer must operate at relatively high speeds and, thus, the response time of the hammer must be short. Therefore, the hammers must be designed to have the smallest possible mass and thickness, such that the space required therefor and the inertia thereof are minimal. With minimal inertia, even the relatively small amount of electromagnetic force developed will be sufficient to displace the hammer at the required high speed.

The flat coils mounted on the hammer frames also generate heat when electrically energized. Since the amount of space provided for each hammer is extremely small and the hammers are spaced closely together, a significant amount of heat build-up occurs during operation of this type of head also. However, this heat is difficult to dissipate in a manner which does not interfere with the operation of the head.

The flat coil is mounted on, and carried by, the displaceable hammer frame. To be effective, it is necessary that any heat dissipating device be mounted in thermal communication with the coil. Thus, the heat dissipating device must also be mounted on and displaceable with the hammer. However, conventional heat sinks inherently require a large amount of space and have a significant amount of mass. Such heat sinks cannot be used in this situation because the space required for, and the mass of, the heat sink would be far greater than the space allotted for, and the mass of, the hammer itself, thereby significantly increasing the space required for each hammer and the inertia of the hammer. Displacement of a hammer of such increased size and mass would require a much greater electromagnetic force than can be developed in this type of head.

Since the use of conventional heat dissipating devices is clearly contraindicated in this situation, a method of air cooling the hammer has been attempted. Openings in the top and bottom of the head have been provided, one of which is connected by means of a conduit or the like to an air blower or fan. The blower or fan continuously provides a stream of cool air through the head as the head is being operated. While an air cooling system such as this is capable of removing the heat generated by the hammers, it increases the size, weight and complexity of the printer, as well as generating additional noise and vibration. It is not, therefore, the optimum solution to the heat accumulation problem.

Another problem associated with hammers of this type relates to the structural strength of the hammer and, particularly, that part of the hammer where the flexible elongated portion, which serves to mount the hammer to the head, joins the frame portion, which carries the flat coil. This part of the hammer is the part most vulnerable to stress developed when the print wire impacts the paper and, thus, is most apt to fracture. While it would certainly be possible to structurally reinforce this part of the frame by making same thicker, as compared to the remainder of the frame, or embedding reinforcing elements therein, both of these solutions result in an increase in the mass and thickness of the hammer, both of which are to be avoided.

A third problem associated with hammers of this type relates to the manner of mounting the print wire thereto. Normally, the hammer frame is stamped out of a sheet of aluminum, because of the high strength per unit weight and flexibility of this substance. The print wire is normally composed of tungsten, a substance which is extremely wear-resistant. There is, however, no conventional method or structure known which can form a joint or bond between an aluminum element and a tungsten element with sufficient strength and rigidity to withstand forces of the magnitude to which the hammer will be subjected. Thus, various complex ways of making the joint between the hammer and the print wire have been attempted. However, none of these mounting methods has heretofore been acceptable.

It is, therefore, a prime object of the present invention to provide a hammer for a dot matrix print head or the like having heat dissipating means mounted on and displaceable with the hammer.

It is another object of the present invention to provide a hammer for use in a dot matrix print head or the like wherein the heat dissipating means comprises a thin sheet of thermally conductive metallic foil which is affixed to the hammer frame.

It is another object of the present invention to provide a hammer for use in a dot matrix print head or the like wherein the heat dissipating means comprises a pair of thermally conductive metallic foils, mounted on opposite sides of the frame, so as to retain the coil intact and in proper position with respect to the frame.

It is another object of the present invention to provide a hammer for use in a dot matrix print head or the like wherein the exterior surface of the thermally conductive metallic foil sheet acts as a bearing surface protecting the coil and frame from wear caused by contact with other parts of the head, as the hammer is displaced.

It is another object of the present invention to provide a hammer for use in a dot matrix print head or the like wherein the mounting structure for the print wire is located on the frame portion at the center of percussion of the hammer, so as to reduce torsional vibrations within the hammer normally caused by impact of the print wire and, thus, stress on the part of the hammer joining the flexible elongated mounting portion with the coil carrying portion.

It is another object of the present invention to provide a hammer for use in a dot matrix print head or the like wherein a novel structure for joining the tungsten print wire to the aluminum hammer is provided.

In accordance with the present invention, a hammer for use in a dot matrix print head is provided. The hammer carries an electrically energizable coil which is situated in a magnetic field and is displaceable relative to the field, between a rest position and a print position, when the coil is energized. The hammer comprises a coil carrying portion and means for resiliently mounting the coil carrying portion to the head. The coil carrying portion comprises a frame to which a flat coil is mounted and means, mounted on the frame and displaceable therewith, for dissipating heat from the coil.

The heat dissipating means comprises a sheet of thermally conductive foil affixed to the frame and extending therefrom into contact with the coil. The foil is extremely thin and has very small mass so as not to increase the size or inertia of the hammer.

The frame has a recess therein into which the coil is received. The thermally conductive foil sheet has a first portion affixed to one side of the frame and a second portion which extends from the frame over at least a part of the recess so as to contact and substantially cover a side of the coil.

The coil has a central opening therein. Preferably, the second portion of the sheet also has an opening therein. The coil opening substantially coincides with the opening in the second portion of the sheet. The outer periphery of the sheet substantially coincides with the outer periphery of the frame.

The sheet has a smooth exterior surface. The exterior surface forms a bearing surface, protecting the frame and the coil mounted thereto from wear caused by contact with other parts of the head, as the hammer is displaced.

The coil has two leads extending therefrom. The mounting means comprises a flexible elongated member, having a recess therein into which one or both of the leads is situated. The thermally conductive foil sheet preferably extends from the coil carrying portion, along the elongated member, so as to cover the recess and enclose the lead or leads therein.

Preferably, the heat dissipating means comprises first and second thermally conductive foil sheets, the sheets being affixed to different sides of the frame and respectively extending therefrom into contact with different sides of the coil. Thus, the coil is at least partially situated between the sheets so as to keep the coil intact and to accurately maintain the position of the coil relative to the frame. The exterior surface of each sheet comprises a smooth bearing surface which serves to protect the frame and the coil mounted thereon from wear caused by contact with other parts of the head as the hammer is displaced.

The hammer also comprises a print wire. A portion of the frame is provided for mounting the print wire. The print wire mounting portion is situated at the center of percussion of the hammer, so as to reduce the stress on the part of the hammer between the elongated portion and the coil carrying frame portion thereof. In addition, back-stop means are provided extending from the frame portion, at a position in alignment with the print wire mounting portion.

The print wire mounting portion of the frame comprises a part which extends from the coil carrying portion of the frame, the surfaces of which are substantially coplanar with the surfaces of the coil carrying portion and has print wire retaining means thereon. The print wire retaining means comprises a recess, elongated in the direction of hammer displacement, formed along the axis or center line of the mounting portion by cutting a series of slots therein so as to form a plurality of clamping elements which bridge or transverse the axis. The elements are bent such that alternate elements are located at opposite sides of the axis. The elements frictionally engage the print wire so as to join same to the frame. In addition, a thin layer of adhesive may be used to further secure the print wire.

Each element is compressed at the point where the element is adjacent the print wire, such that the combined thickness of the element and the radius of the print wire is approximately equal to one-half of the thickness of the hammer. Thus, the thickness of the portion of the frame which holds the print wire is substantially equal to the thickness of the remainder of the hammer. This print wire retaining structure results in a strong but relatively thin joint, because no additional thickness or mass is present due to the use of solder or other means used in prior art methods of attaching the print wire to the hammer.

To these and such other objects as may hereinafter appear, the present invention relates to a hammer for use in a dot matrix print head or the like, as set forth in the following specification and recited in the annexed claims, taken together with the accompanying drawings, wherein like numerals refer to like parts, and in which:

FIG. 4 is a cross-sectional view, taken along line 4—4 of FIG. 2; and FIG. 5 is a cross-sectional view, taken along line 5—5 of FIG. 2.

Figure 1:
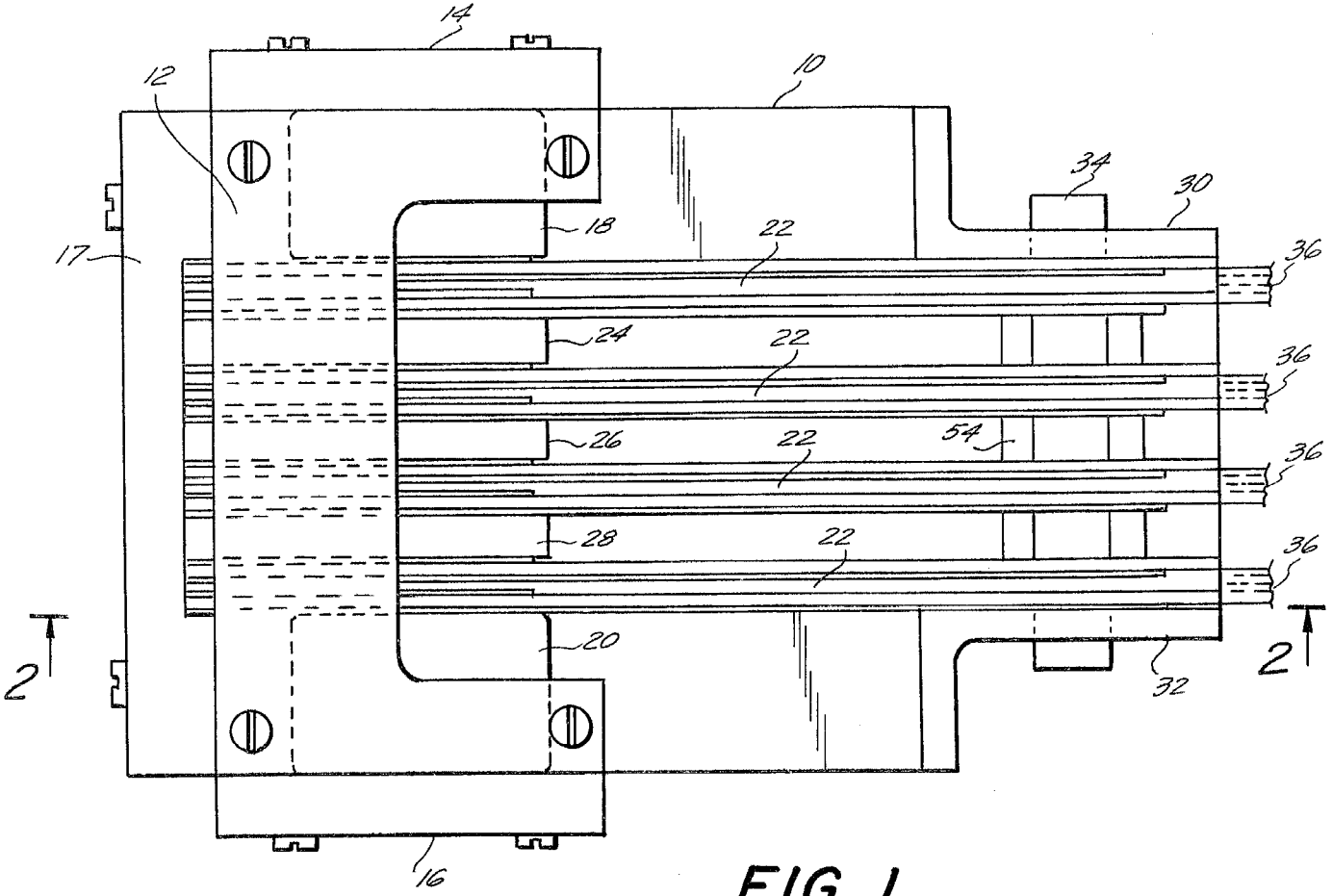
FIG. 1 is a top plan view of the head for a dot matrix printer incorporating the present invention.

As shown in FIG. 1, the head comprises a support structure including a substantially planar bottom member 10, a top member 12, a pair of upstanding side members 14, 16, and a front member 17. Located between side members 14 and 16 are a pair of spaced permanent magnets 18, 20. Between permanent magnets 18 and 20 are four groups of hammers 22, each group preferably comprising seven hammers. Situated between the hammer groups, in alignment with magnets 18 and 20, are three additional magnets 24, 26 and 28. The purpose of magnets 24, 26 and 28 is to shape and enhance the field created by and between magnets 18 and 20, such that the field strength across all hammers 22 is substantially uniform.

Towards the rear (right, as seen in FIG. 1) of bottom member 10 is situated a pair of upstanding brackets 30, 32 which are spaced from each other such that the ends of hammers 22 can be situated therebetween. Passing through brackets 30 and 32 is a shaft or rod 34 to which the ends of hammers 22 are individually mounted in cantilever fashion. Each hammer is connected, by means of a pair of leads 36, to hammer actuating circuitry (not shown) which is of conventional design.

Figure 2:
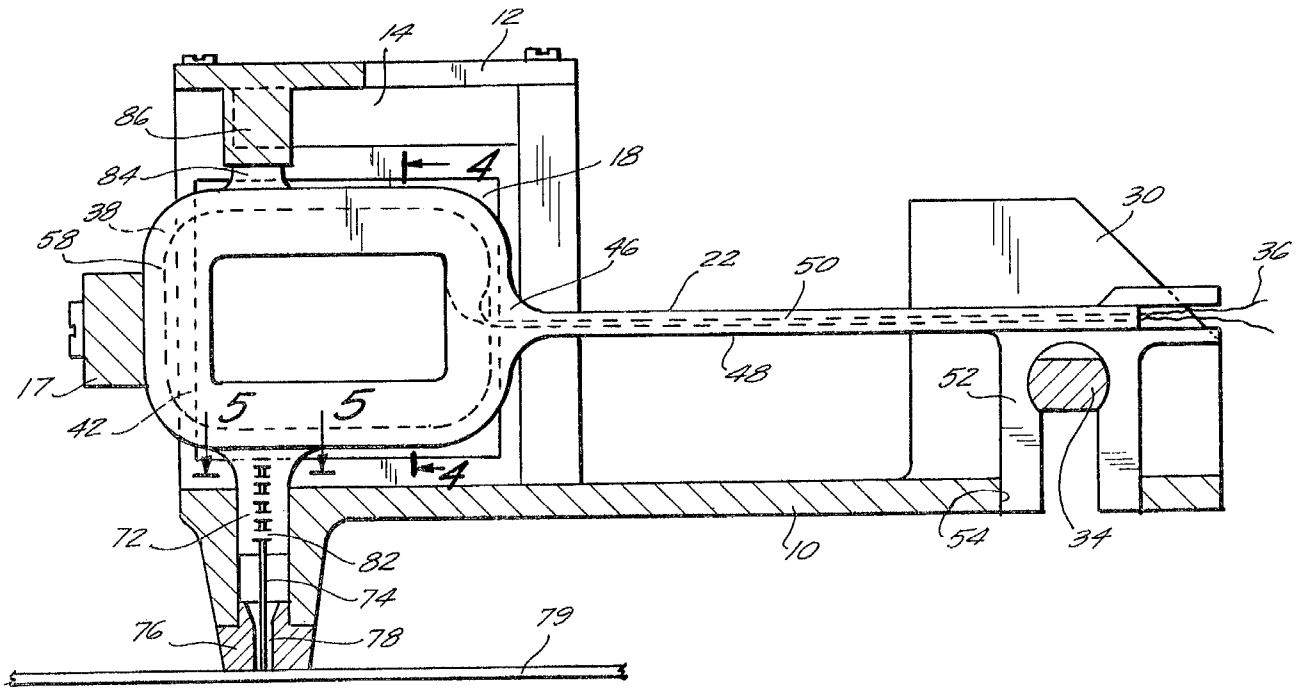
FIG. 2 is a cross-sectional view, taken along line 2—2 of FIG. 1, showing the structure of one of the hammers.
Figure 3:
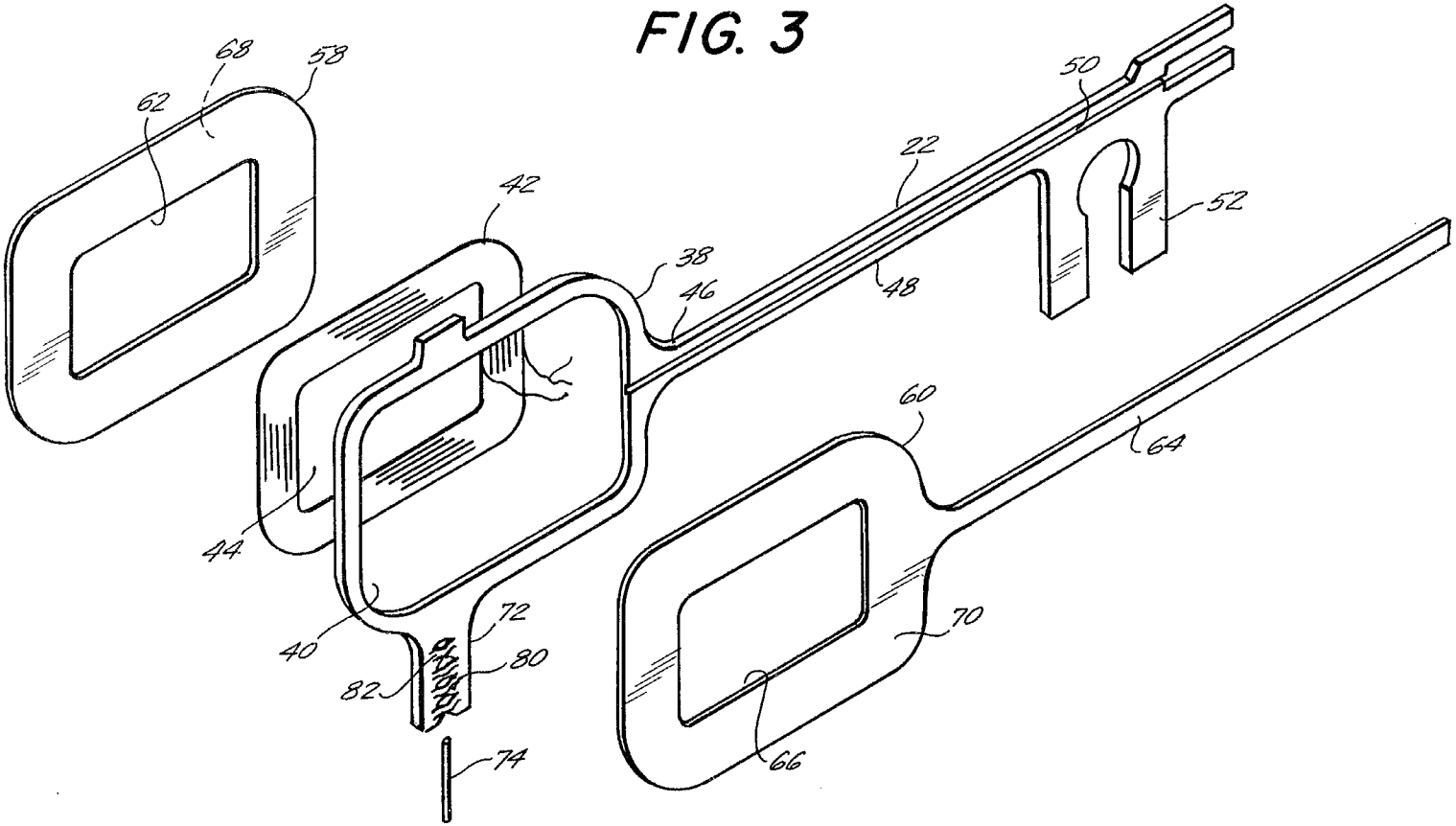
FIG. 3 is an exploded isometric view of the hammer illustrated in FIG. 2.

As best seen in FIGS. 2 and 3, each hammer 22 includes a substantially rectangular frame-like portion 38 having a recess 40 therein, also of substantially rectangular configuration. A flat multi-turn coil 42 is adapted to be received within recess 40 of frame portion 38. Coil 42 also has an opening or recess 44 therein. Frame 38 comprises the coil carrying portion of hammer 22.

Connected to frame portion 38, by means of a tapered neck portion 46, is a flexible elongated mounting portion 48, adapted to mount the hammer to the support structure of the head. Elongated portion 48 has a recess 50 therein designed to receive leads 36 of coil 42, such that same can be connected to the hammer energizing circuitry.

Extending downwardly from the rear portion (right, as seen in FIGS. 2 and 3) of elongated portion 48 is a bifuricated part 52 having a central opening into which shaft or rod 34 is received, such that hammer 22 can be mounted in cantilever fashion to the head. As seen in FIG. 2, bottom member 10 is provided with a rectangular opening 54, designed to receive the bottoms of bifuricated parts 52 therein. In this manner, the proper position of bifuricated part 52 and, thus, hammer 22, with respect to the head support structure, is maintained.

Affixed to either side of frame portion 38 is a heat dissipating member 58, 60. Heat dissipating member 58 comprises a substantially rectangular sheet of thermally conductive foil, approximately 1/1000 of an inch thick, preferably composed of copper or a copper alloy. The outer periphery of sheet 58 substantially coincides with the outer periphery of frame portion 38, to which it is affixed. Member 58 has a central opening 62 which substantially coincides with the opening 44 in coil 42. The distance between the periphery of member 58 and the edge of opening 62 is equal to, or greater than, the corresponding dimensions of frame 38 plus coil 42. Member 58 will thus cover the side of the frame portion to which it is affixed and extend over a part of recess 40, so as to cover one side of coil 42 also.

Affixed to the opposite side of frame portion 38 is member 60, having a configuration and being mounted to the opposite side of frame 38 in a manner substantially identical to that of member 58, except that an elongated portion 64 extends therefrom in alignment with portion 48 of hammer 22. The purpose of elongated portion 64 of member 60 is to provide a cover for elongated recess 50 in portion 48 of hammer 22 such that the leads 36 situated therein are completely enclosed, thereby preventing breakage or tangling thereof. Member 60 also has an opening 66 which coincides with opening 44 in coil 42 and is designed to cover the other side of frame 38 and coil 42. Each of the members 58, 60 is provided with a relatively smooth exterior surface 68, 70, respectively.

Members 58 and 60 serve three separate functions. First, these members act as heat dissipating members or heat sinks which facilitate the dissipation of heat developed by coil 42 upon electrical actuation thereof. It should be appreciated that the heat dissipating function is performed in a manner which does not adversely affect the operation of the hammer. More particularly, the heat dissipating members 58 and 60 do not substantially add to the mass or thickness of the hammer because of the extreme thinness and low mass thereof. Thus, members 58 and 60 do not contribute substantially to the inertia of the hammer and, therefore, additional electromagnetic force need not be developed to displace the hammer when the heat dissipating members 58 and 60 are affixed thereto. In addition, the thickness of the hammer is not substantially increased by the presence of the members 58 and 60. A multitude of such hammers can still be situated between the magnets without requiring additional space. Both of these factors are extremely important in a situation where, as here, the heat dissipating members must be carried on the hammer and, therefore, be displaceable therewith.

Second, members 58 and 60 serve to hold coil 42 intact and to position and mount same relative to frame portion 38. Preferably, coil 42 comprises a multitude of turns of wire with a self-bonding topcoat, such as is sold by the Phelps, Dodge Magnet Wire Company, of Fort Wayne, Ind., under the trademark SY-BONDEZE. Such coils can be bonded by either of two methods--heat bonding or solvent bonding. In heating bonding, the winding is brought to the required temperature, either in an oven or by resistance heating. In solvent bonding, the wires pass through a solvent saturated felt wick as the coil is being wound. In either case, the procedure tends to bond the individual turns of wire together. However, it is possible, under normal stresses developed by the flexing of the hammer as same is displaced, to unravel some of the wire turns. Members 58 and 60 prevent any unravelling of the coil turns because coil 42 is sungly sandwiched between members 58 and 60 when same are mounted to frame portion 38 and, thus, assure that the coil will remain intact during operation of the hammer.

As mentioned above, members 58 and 60 are affixed to opposite sides of the frame portion 38 with coil 42 situated or sandwiched therebetween. With this configuration, coil 42 is automatically properly positioned within recess 40 of frame portion 38 and is retained in the proper position by engagement with the interior surfaces of members 58 and 60.

Third, the smooth exterior surfaces 68 and 70 of members 58 and 60 serve as bearing surfaces, protecting the hammer frame and coil 42 from wear caused by rubbing against other portions of the head as the hammer is displaced. Thus, the useful life of the hammer and the coil are enhanced by protecting same from wear. Any wear which does take place, therefore, is confined to surfaces 68 and 70 wherein it will not damage the essential structures of the hammer.

Extending from the bottom of frame member 38 is a protruding part 72 to which a print wire 74 is affixed. Print wire 74 extends downwardly through a wire bearing 76, located at the bottom of the head on member 10 adjacent the paper 79 which is to be printed on. Bearing 76 has a plurality of spaced openings 78 therein, one opening 78 being provided for the print wire 74 of each of the hammers 22. The purpose of wire bearing 76 is to maintain the proper positioning between the impact ends of the print wires 74.

Hammer 22 is preferably composed of aluminum because of the light weight and flexibility of this substance. Moreover, the hammer itself can be stamped from a sheet of aluminum relatively easily. On the other hand, the print wire 74 is preferably made of tungsten or the like which is a highly wear-resistant substance. Most of the wear on wire 74 will take place at the impact end which contacts the paper. Substantial wear of the impact end will reduce the clarity of the dot printed thereby and, eventually, will cause no dot at all to be printed when the hammer is actuated. It is therefore necessary that the print wire be formed of a highly wear resistant substance.

Unfortunately, conventional bonding techniques which employ adhesives or solders alone will not serve to form an acceptable joint between members made of aluminum and tungsten. The junction between the hammer frame and the print wire must be sufficiently rigid and strong to withstand the forces created by rapid hammer displacement and return. Moreover, such a joint must be formed in a manner which does not substantially increase the width or mass of the hammer at the point where the joint is made. Since no known bonding technique can meet these criteria, it was necessary to develop an entirely new joining technique for this purpose.

As best seen in FIGS. 2 and 5, the print wire carrying part 72 of hammer 22 is elongated in the direction of displacement. A recess 80 is formed through the axis or center line of part 72, into which the print wire is received. Recess 80 is elongated in the direction of print wire displacement. Recess 80 is formed by creating a plurality of equally spaced slots in a direction transverse to the direction of print wire displacement, such that a plurality of individual clamping elements 82, also extending in a direction transverse to the direction of print wire displacement, are also formed. As the slots are formed, elements 82 are compressed and bent either upwardly or downwardly with respect to the axis or center line of member 72. This can be done by simply stamping or crimping part 72.

More particularly, alternating elements 82 are situated on opposite sides of the axis or center line of part 72. As best seen in FIG. 5, every other element 82 is bent downwardly so as to be below the axis or center line, the remaining elements 82 being bent upwardly so as to be above the axis or center line. This configuration creates an elongated recess 80, in the direction of displacement, into which print wire 74 is received and frictionally engaged by elements 82. The top end of the print wire is firmly lodged against the edge of the uppermost slot 83 (see FIG. 4), such that the impact force on the print wire is absorbed by the frame. Thus, the print wire is clamped within recess 80 by elements 82, alternating ones of which are on different sides of the print wire. A thin layer of adhesive may also be used to further secure the print wire to the elements 82. However, this adhesive layer is so thin that it does not significantly add to the thickness of the frame. This configuration forms a rigid, strong joint between the tungsten print wire 74 and the aluminum print wire mounting part 72 of the frame.

As is best seen in FIG. 4, the thickness of frame 22 is approximately 0.016 inch. Each of the heat dissipating members 58 and 60 adds approximately 0.001 inch to the thickness of the frame, such that the overall thickness is approximately 0.018 inch thick. Since the frame is 0.016 inch thick, so is part 72 and, thus, elements 82, which are formed from part 72, prior to compression. However, as members 82 are bent in opposite directions with respect to the axis or center line of part 72 to form recess 80, they are compressed such that the central portions thereof, that is, the portions adjacent print wire 74, have a reduced thickness of approximately 0.003 inch. Thus, even when elements 82 are correctly positioned on opposite sides of print wire 74, which has a diameter of approximately 0.013 inch, the overall width of the print wire mounting part 72, at its widest point, is only approximately 0.019 inch thick, or only approximately 0.001 inch thicker than the frame with heat dissipating elements 58 and 60 mounted thereon. In other words, the thickness of each of the elements 82 plus the radius of the print wire is approximately equal to one-half of the thickness of the frame. Thus, the structure of the joint does not add appreciably to the width of the hammer. In addition, since no foreign substance (except for a thin layer of adhesive) need be placed on the hammer to bond the print wire thereto, only an insignificantly small amount of additional mass is imparted to the hammer by the joining structure.

Aligned with print wire joining portion 72, but situated on the opposite or top portion of frame portion 38, is a stop member 84 which cooperates with energy absorbing stop 86 extending downwardly from top member 12 so as to limit the rebound of the hammer. The correct positioning of the wire mounting portion 72, and thus print wire 74, and the stop portion 84 relative to the frame 38, are very important to the proper functioning of the hammer.

It has been found, experimentally, that the portion of the hammer most vulnerable to stresses caused by flexing of the hammer and impact of the print wire is the portion where tapered neck 46 joins elongated portion 48. Clearly, it is desirable to make hammer 22 as thin and as light as possible so as to reduce the amount of force which is required to achieve the necessary displacement. However, it is also necessary that the hammer have sufficient strength to withstand repeated impact. While it is possible to make the hammer 22 extremely thin and to reinforce the most vulnerable portion thereof, that is, the point where neck 46 joins elongated portion 44, such reinforcement would add to the mass and, possibly, the thickness of the hammer and, therefore, be undesirable.

An analysis of the forces involved shows that the vulnerable portion between neck 46 and portion 48 tends to break because of torsional vibrations which are created on impact. It has been theorized that if print wire 48 is mounted to hammer 22 on a line passing through the center of percussion of the hammer, no torsional vibrations will result from impact. Thus, the vulnerable portion of the hammer need not be reinforced against these normally present torsional vibrations which tend to break the hammer at that point. In other words, the hammer can withstand greater impact force if the print wire is properly positioned.

The center of percussion of the hammer can be calculated by finding the center of rotating mass. This can be approximated by either considering the movement of the hammer to be analogous to that of a pendulum, or by using conventional formulas for cantilevered beams. It has been experimentally confirmed that when the print wire is on a line which passes through the center of percussion of the hammer, the hammer will withstand much greater impact forces before breaking.

It will therefore be appreciated that the present invention relates to a hammer for a dot matrix printer which is extremely thin and has very small mass, such that only a small amount of electromagnetic force need be developed to displace same and that a plurality of such hammers can be situated between a single pair of permanent magnets. Each hammer includes a frame with a recess into which an electrically energizable flat coil is received. Affixed to the opposite sides of the frame and in contact with the sides of the coil are thermally conductive metallic foil sheets which serve to dissipate heat from the coil as the coil is electrically energized. In addition, the heat dissipating foil sheets also retain the coil intact and in the proper position relative to the frame. The sheets are displaceable with the frame, but the mass thereof is minimal so as not to significantly increase the inertia of the hammer. The exterior surfaces of the sheets form bearing surfaces to protect the frame and the coil from wear caused by contact with other parts of the head as the hammer is displaced.

A print wire is affixed to the frame at the center of percussion thereof so as to eliminate torsional vibrations normally caused by impact, thereby increasing the amount of impact force which the hammer can withstand.

The print wire is mounted to the frame by creating an elongated recess in the frame, in the direction of print wire displacement with alternate transverse elements situated on opposite sides of the recess. The print wire is securely clamped or frictionally engaged between the elements. This method of connection results in an extremely rigid and strong joint without significantly increasing the thickness of the frame at the point of connection.

While only a single preferred embodiment of the present invention has been disclosed herein for purposes of illustration, it is obvious that many variations and modifications could be made thereto. It is intended to cover all of these variations and modifications which fall within the scope of the present invention, as defined by the following claims:

We claim:

1. A hammer for use in a dot matrix print head, the hammer carrying an electrically energizable coil, adapted to be situated in the magnetic field, and being displaceable relative to the field between a rest position and a print position when the coil is energized, said hammer comprising a coil carrying portion, means for resiliently mounting said coil carrying portion to the head, and a print wire, said coil carrying portion comprising means for mounting said print wire, said print wire mounting means comprising first and second spaced, substantially coplanar sections, partially defining a print wire receiving recess elongated substantially along the direction of displacement, and first and second clamping means defined by a plurality of spaced slots formed in said coil carrying portion, said clamping means extending between said sections and across the recess, said clamping means being situated to engage opposite sides of said print wire and adapted to retain said print wire substantially within the plane of said sections.

2. The hammer of claim 1, wherein said print wire mounting means further comprises an edge extending between said sections, substantially perpendicular to the direction of displacement, defining the end of the recess and wherein the end of said print wire is situated adjacent said edge.

3. The hammer of claim 1, wherein said clamping means are situated substantially in the plane of said sections.

4. The hammer of claim 1, wherein said clamping means are integral with said sections.

5. The hammer of claim 1, wherein said clamping means are spaced apart along the direction of displacement.

6. The hammer of claim 1, wherein said clamping means frictionally engage said print wire.

7. The hammer of claim 1, wherein said clamping means are bent in opposite directions relative to the center line of the recess.

8. The hammer of claim 1, wherein the portions of said clamping means engaging said print wire are thinner than said sections.

9. The hammer of claim 8, wherein said portions of said clamping means are compressed.

10. The hammer of claim 1, wherein the recess is situated along a line passing through the center of percussion of said coil carrying portion.

11. A hammer for use in a dot matrix print head, the hammer carrying an electrically energizable coil adapted to be situated in a magnetic field and being displaceable relative to the field between a rest position and a print position, said hammer comprising heat dissipating means mounted on and displaceable with said hammer, a coil carrying portion, and means for resiliently mounting said coil carrying portion to the head, said coil carrying portion comprising a frame having a central recess within which said coil is mounted, said heat dissipating means comprising a thermally conductive foil sheet, said sheet being affixed to and covering the surface of said frame and extending inwardly thereof into said recess to substantially cover said coil, said coil having a lead and said mounting means comprising an elongated member having a recess therein into which said lead is situated and wherein said sheet extends from said coil carrying part of the frame along said member covering said recess.

12. The hammer of claim 11, wherein said coil has an opening therein and said sheet has an opening and wherein said openings are substantially aligned.

13. The hammer of claim 11, wherein said sheet has a substantially smooth exterior surface which constitutes at least a part of the exterior surface of the hammer and covers said frame and said coil to protect same from contact with other parts of the head.

14. The hammer of claim 11, wherein said heat dissipating means further comprises a second thermally conductive foil sheet affixed to the other side of said frame and extending therefrom into thermal engagement with at least a portion of the other surface of said coil.

* * * * *